US008434406B2

(12) United States Patent
Gsell et al.

(10) Patent No.: US 8,434,406 B2
(45) **Date of Patent: *May 7, 2013**

(54) HANDLING DEVICE OF A PRINTING PRESS

(75) Inventors: Thomas Gsell, Dillingen (DE); Rudolf Stroh, Duernau (DE)

(73) Assignee: manroland AG, Offenbach/Main (DE)

( * ) Notice: Subject to any disclaimer, the term of this patent is extended or adjusted under 35 U.S.C. 154(b) by 828 days.

This patent is subject to a terminal disclaimer.

(21) Appl. No.: 12/172,018

(22) Filed: Jul. 11, 2008

(65) Prior Publication Data

US 2009/0013890 A1 Jan. 15, 2009

(30) Foreign Application Priority Data

Jul. 14, 2007 (DE) ..... 10 2007 032 941

(51) Int. Cl.
*B41F 27/12* (2006.01)

(52) U.S. Cl.
USPC ..... 101/477; 101/382.1; 101/415.1

(58) Field of Classification Search ..... 101/216, 101/378, 382.1, 415.1, 477
See application file for complete search history.

(56) References Cited

U.S. PATENT DOCUMENTS 5,072,671 A * 12/1991 Schneider et al. ..... 101/467
5,074,212 A * 12/1991 Kobler et al. ..... 101/477
5,127,322 A * 7/1992 Kobler ..... 101/219
2008/0156213 A1 7/2008 Gsell et al.
2009/0211478 A1* 8/2009 Gsell et al. ..... 101/477

FOREIGN PATENT DOCUMENTS

DE 103 38 374 A1 3/2005
DE 10 2004 052 021 A1 5/2006
EP 0 431 364 A2 6/1991
EP 1 927 474 A2 6/2008
JP 1-127347 5/1989

OTHER PUBLICATIONS

English translation of JP 01-127347 Hattori et al. May 1989.*
Article entitled "Roboterarm fur Plattenwechsel", May 2007.*
Pending Patent Application, U.S. Appl. No. 11/943,856, titled "Handling Device of a Printing Press", Inventors Gsell, et al., filed Nov. 21, 2007.

* cited by examiner

*Primary Examiner* — Ren Yan
(74) *Attorney, Agent, or Firm* — Crowell & Moring LLP

(57) ABSTRACT

A handling device of a printing press, in particular for handling printing plates during an automated printing plate change on a printing unit of a printing press, is disclosed. The handling device has a manipulator arm, where one end of the manipulator arm is assigned a manipulator head, which features a handling element, in particular a holding element for printing plates, and the manipulator arm is embodied in a multi-part manner of several segments. A swivel axis is embodied on each end of each segment, around which at least the respective segment can be swiveled, and each swivel axis is assigned a separate drive for providing the respective swivel movement. The other end of the manipulator arm is mounted so it is translatorily and rotationally movable on a traverse or on a frame or on a wall of the printing press.

2 Claims, 5 Drawing Sheets

HANDLING DEVICE OF A PRINTING PRESS

This application claims the priority of German Patent Document No. 10 2007 032 941.7, filed Jul. 14, 2007, the disclosure of which is expressly incorporated by reference herein.

BACKGROUND AND SUMMARY OF THE INVENTION

The invention relates to a handling device of a printing press.

A handling device of a printing press embodied as a printing plate manipulator, which is used for handling printing plates during an automated printing plate change on a printing unit of a printing press, is known from German Patent Document No. DE 10 2004 052 021 A1. The printing plate manipulator disclosed there is comprised of a manipulator arm, wherein a manipulator head is mounted in an articulated manner on one end of the manipulator arm. The manipulator head features a holding element for printing plates. The manipulator arm of the printing plate manipulator is displaceably mounted in a guide of a frame of a printing unit on the end of the manipulator arm that is opposite from the end on which the manipulator head is mounted in an articulated manner, making it possible for the entire manipulator arm to be moved back and forth in the vertical direction. This end of the manipulator arm is furthermore assigned an articulation so that the same can also swivel.

The applicant's German Patent Document No. DE 10 2006 054 957 discloses a multi-part manipulator arm comprised of several segments, wherein a swivel axis is embodied on each end of each segments, around which at least the respective segment can be swiveled, and wherein each swivel axis is assigned a separate drive for providing the respective swivel movement. This new handling device can be mounted or swiveled more flexibly in a manner requiring less space than handling devices known from the prior art.

Starting herefrom, the present invention is based on the objective of creating a novel handling device of a printing press, which can operate different printing couples from multiple printing units.

According to the invention, the manipulator arm is embodied in a multi-part manner of several segments, wherein a swivel axis is embodied on each end of each segment, around which at least the respective segment can be swiveled, and wherein each swivel axis is assigned a separate drive for providing the respective swivel movement. In addition to the swivel axes, the manipulator arm is mounted on one end so it is translatorily and rotationally movable.

In this case, the manipulator arm can be mounted either on a traverse, for example between two printing towers, or on a frame or on a wall of the printing press. The rotational axis of the end of the manipulator arm can run perpendicular to the erection plane of the printing press.

Alternatively or as a supplement thereto, the direction of the translatory motion can run perpendicular or parallel to the rotational axis of the printing cylinders of the printing press. In order to realize the translatory motion running parallel to the rotational axis of the printing cylinders, in one design the traverse can be moved parallel to the rotational axis of the printing cylinders so that it can be extended laterally together with the manipulator arm out of the printing couples in order to fetch the printing plate(s) that are to be newly loaded in the case of a central plate supply.

The manipulator arm preferably has a first segment for connecting the same to a frame or to a wall of the printing press, a second segment for connecting the manipulator head to the manipulator arm and at least a third segment, via which the first segment and the second segment are connected to one another. The end of the first segment, which is used to connect the manipulator arm to the frame or to the wall, is designed to be stationary in particular.

A swivel axis is respectively embodied on the end of the first segment via which the manipulator arm is attached to the frame or the wall of the printing press, as well as on the end of the second segment via which the manipulator head is attached to the manipulator arm, as well as on the ends of the segments, on which the first segment and the second segment are connected to a third segment and, as the case may be, the third segments are connected among one other, wherein each of these swivel axes is assigned a drive respectively.

Additional preferred embodiments of the invention are disclosed by the following description. Without being limited hereto, exemplary embodiments of the invention are explained in greater detail on the basis of the drawings.

DETAILED DESCRIPTION OF THE DRAWINGS

Figure 1:
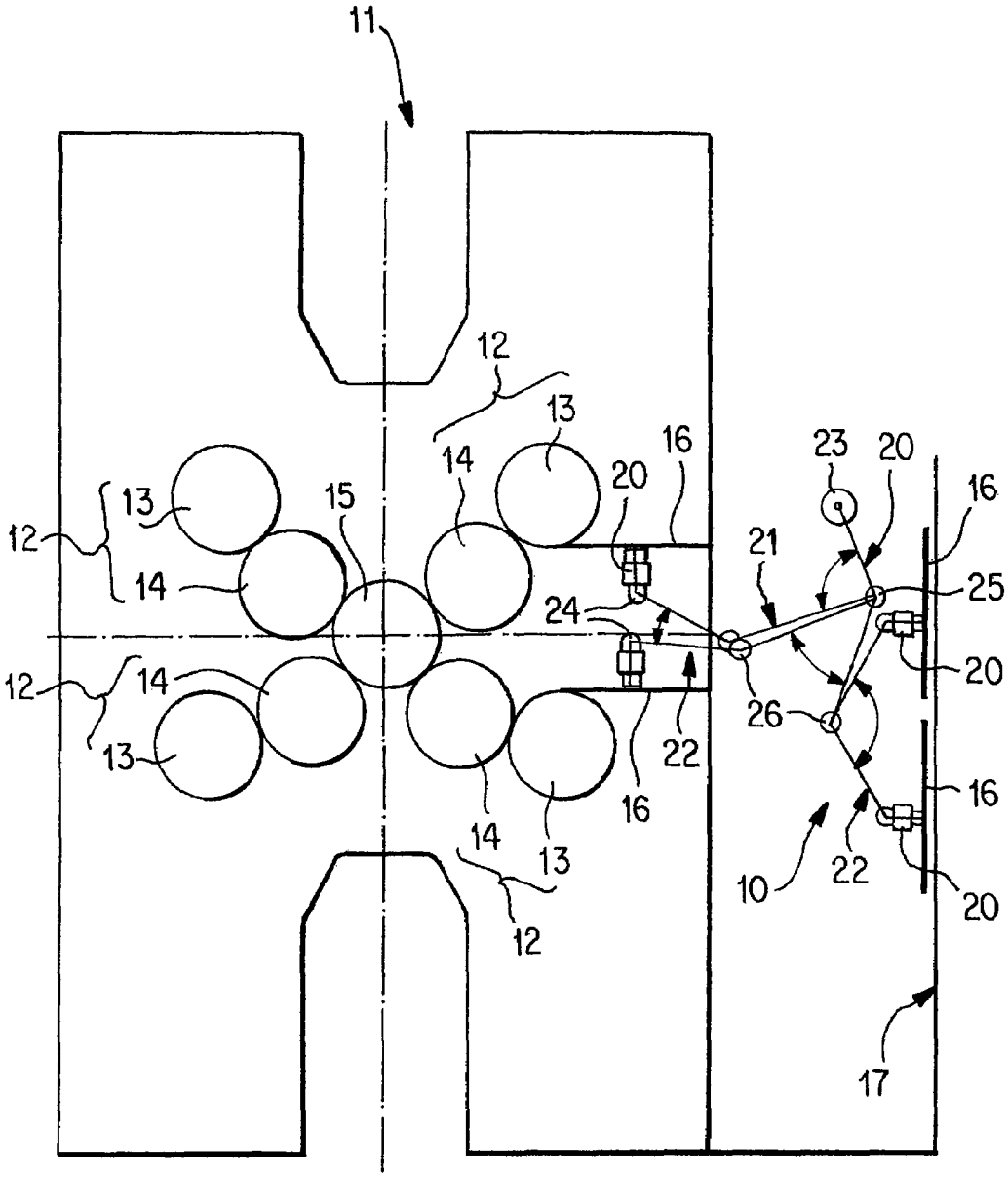
FIG. 1 is a schematic representation of a printing unit of a web-fed printing press with an inventive handling device.

FIG. 1 shows a schematic representation of an inventive handling device 10 of a printing press together with a printing unit 11 of a web-fed rotary printing press that is embodied as a satellite printing unit. The satellite printing unit in FIG. 1 has four printing couples 12, wherein for each printing couple 12 only the plate cylinders 13 and transfer cylinders 14 are shown. All transfer cylinders 14 of the printing couples 12 roll off of one impression cylinder 15.

In the depicted exemplary embodiment, the inventive handling device 10 is used for handling printing plates 16 during an automatic or automated printing plate change on the printing couples 12 of the printing unit 11. FIG. 1 depicts the handling device 10 in a total of four different positions in order to show that it can be positioned flexibly in the space. In two of the depicted positions, the handling device 10 is receiving printing plates 16 that are kept in readiness at a web guide wall 17. In the other two depicted positions, on the other hand, the handling device 10 is delivering printing plates 16 to the plate cylinders 13 of printing couples 12.

Figure 2:
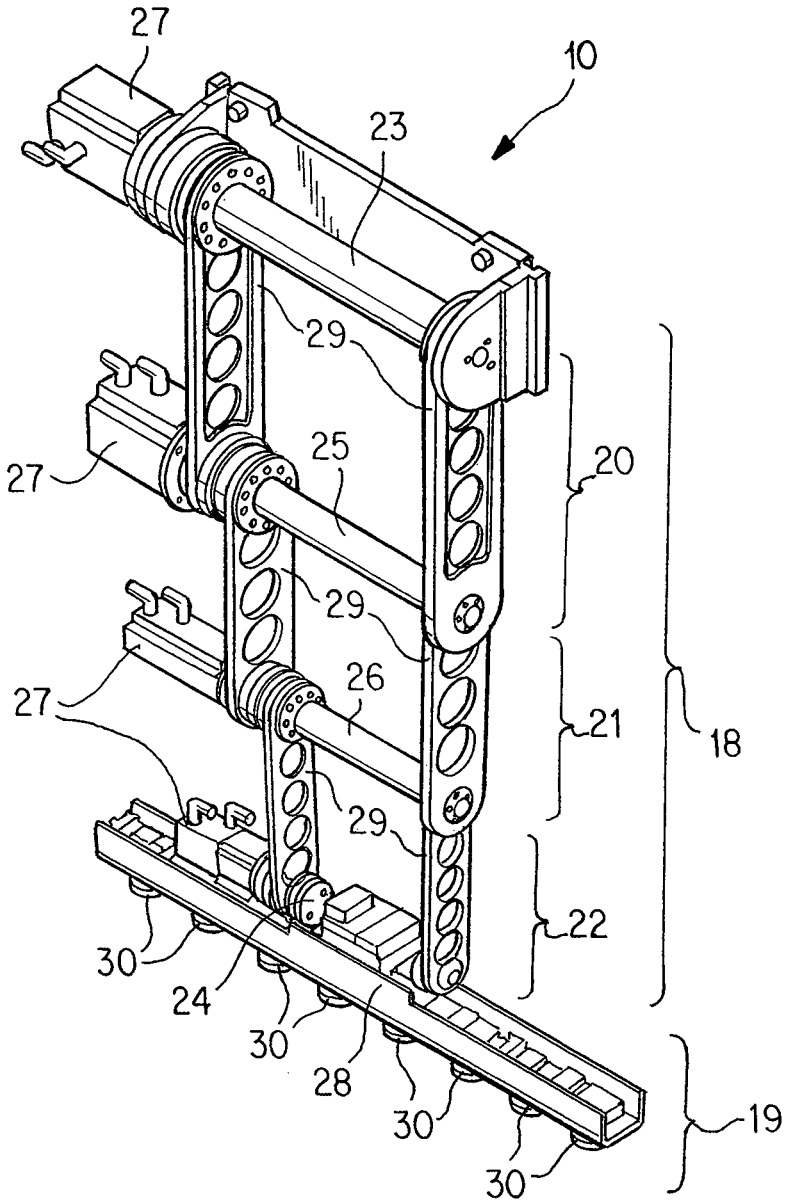
FIG. 2 is a perspective view of an inventive handling device of a printing press.
Figure 4:
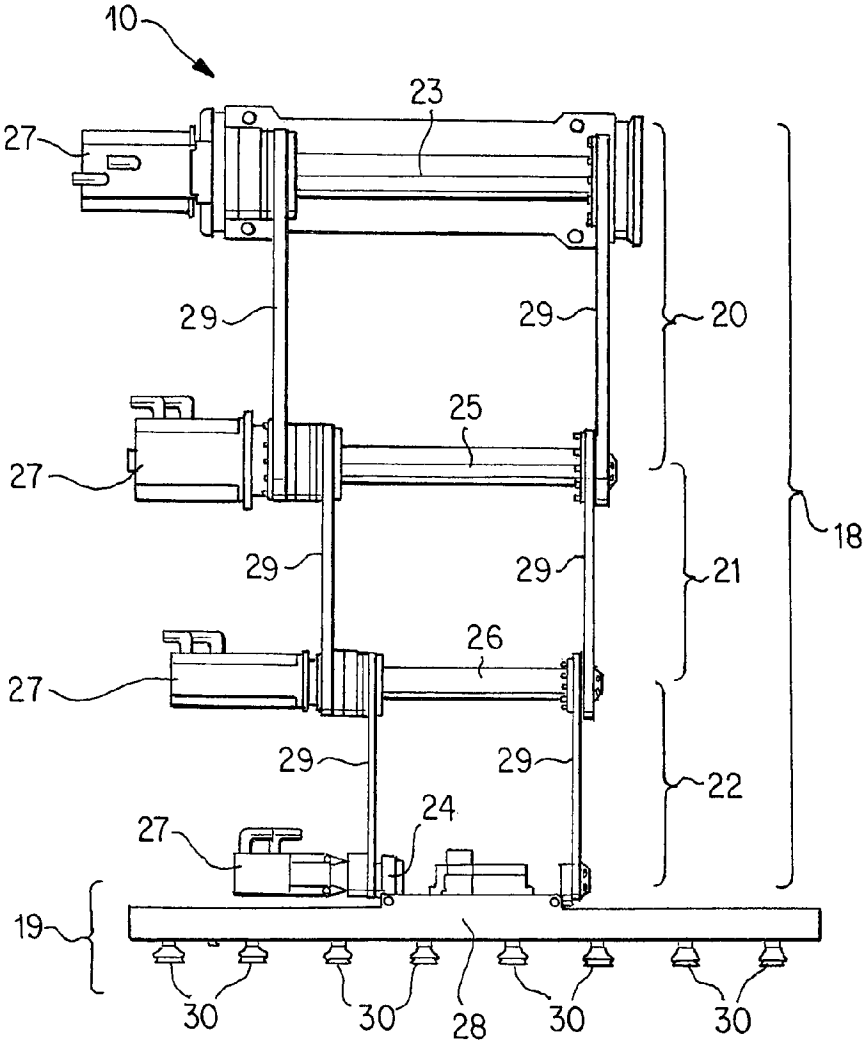
FIG. 4 is a front view of the handling device from FIG. 2.
Figure 3:
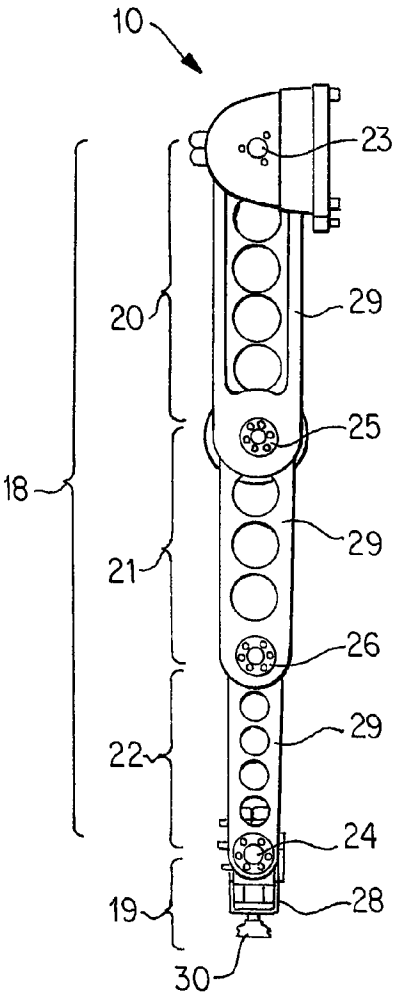
FIG. 3 is a side view of the handling device from FIG. 2.

FIGS. 2 through 4 show the inventive handling device 10 in more detail. Thus, the handling device 10 is comprised of a manipulator arm 18 and a manipulator head 19, wherein the manipulator head 19 features a handling element 28.

According to the invention, the manipulator arm 18 is embodied in a multi-part manner of several segments, wherein in the depicted exemplary embodiment the manipulator arm 18 is comprised of three segments 20, 21 and 22. A first segment 20 is used to connect the manipulator arm 18 to a frame or a wall of the printing press, and a second segment 22, on the other hand, is used to connect the manipulator head 19 to the manipulator arm 18. A third segment 21 is used to connect the first segment 20 to the second segment 22, wherein, in contrast to the depicted exemplary embodiment, several third segments can also be arranged between the first segment 20 and the second segment 22.

A swivel axis is embodied on each end of the segments 20, 21 and 22. Thus, a first swivel axis 23 is embodied on the end of the first segment 20, via which the manipulator arm 18 is connected to the frame or the wall of the printing press. A second swivel axis 24 is embodied on the end of the second segment 22, which is used to connect the manipulator head 19 to the manipulator arm 18. Additional swivel axes 25 and 26 are embodied on the ends of the segments 20, 21 and 22, on which the first segment 20 is connected to the third segment 21 as well as the second segment 22 to the third segment 21. The swivel axis 23, which serves to connect the manipulator arm 18 to the frame or the wall of the printing press, is designed to be preferably stationary.

Each swivel axis 23, 24, 25 and 26 is assigned a separate drive 27 in order to guarantee the swivel motion of the segments 20, 21 and 22 relative to one another or the swivel motion of the manipulator head 19 relative to the second segment 22 of the manipulator arm 18 or the swivel motion of the first segment 20 of the manipulator arm 18 relative to the frame or to the wall of the printing press. The drives 27 are electromotive drives. Each segment 20, 21 and 22 of the manipulator arm 18 as well as the manipulator head 19 can be swiveled individually via the drives 27.

In the depicted exemplary embodiment, each segment 20, 21 and 22 of the manipulator arm 18 is formed by two braces 29 running parallel to each other. A swivel axis is assigned to each end of a brace 29 and thus to each end of a segment 20, 21 and 22.

In the depicted exemplary embodiment, the handling element 28 is embodied as a suction device having several suction nozzles 30. At this point, reference is made to the fact that the handling element 28 can be designed to be replaceable in order to thereby, for example, replace a suction device for handling printing plates with a blanket wash-up device or another handling element. The handling element 28, which is embodied as a suction device in the depicted exemplary embodiment, extends over the entire axial extension of the plate cylinders 13 of the printing couples 12 of the printing unit 11.

As already mentioned, the handling element 28 in the depicted exemplary embodiment is embodied as a suction device having several suction nozzles 30. In this case, every two suction nozzles 30 are used for handling a printing plate 16 so that a total of four printing plates can be handled with the suction device depicted in FIGS. 2 through 4. Reference is made to the fact that the number of available suction nozzles is purely exemplary and depends upon the number of printing plates to be handled by each plate cylinder.

Figure 5:
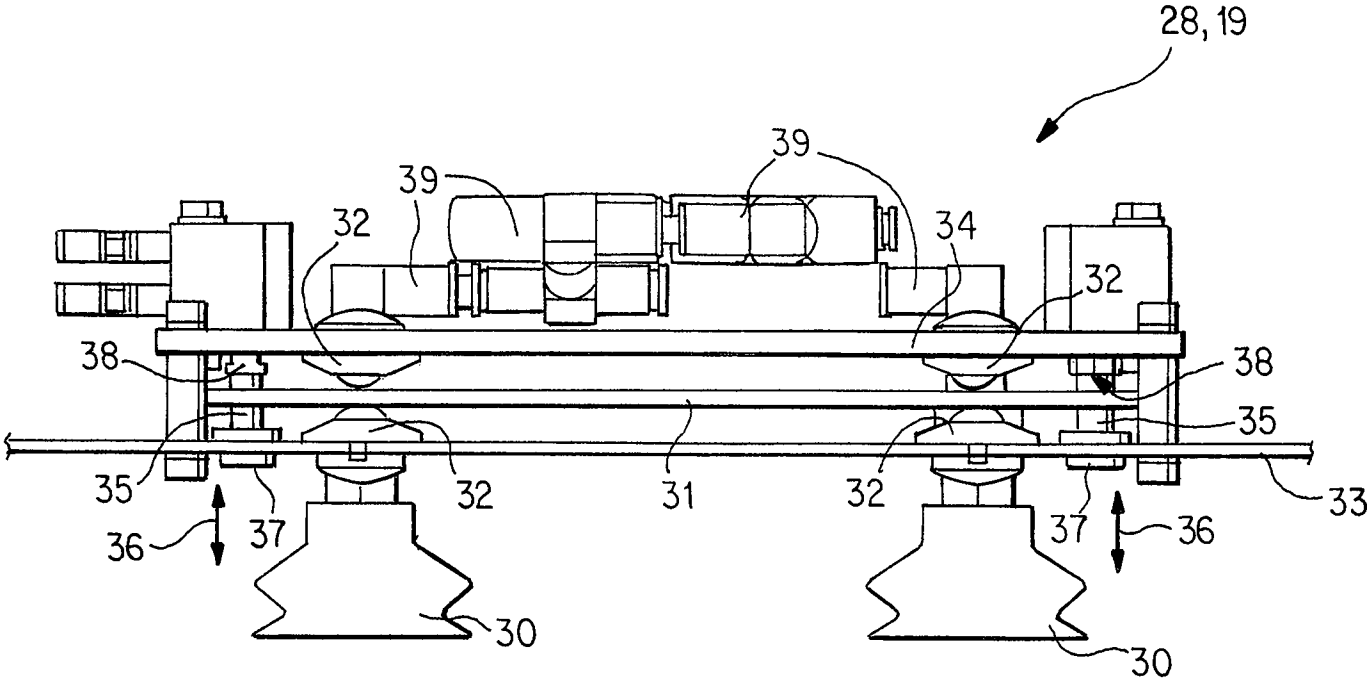
FIG. 5 is a detail of the handling device from FIGS. 2 to 4.

FIG. 5 shows a section of the handling element 28 of the manipulator head 19 embodied as a suction device in the region of two suction nozzles 30. The two suction nozzles 30 are fastened to a support element 31 embodied as a plate, wherein the support element 31 and thus the two suction nozzles 30 are mounted in a floating manner in the handling element 28. Thus, FIG. 5 shows a total of four ball rollers 32, wherein two ball rollers 32 cooperate with an upper side of the support element 31 and two ball rollers 32 cooperate with a lower side of the support element 31.

The ball rollers 32 cooperating with the lower side of the support element 31 are fastened to a traverse 33 of the handling element 28, and the ball rollers 32 cooperating with the upper side of the support element 31, on the other hand, are fastened to a support plate 34.

Cooperating with the ball rollers 32 are locating bolts 35 of a fixation device, which are axially displaceable in the direction of the arrow 36. The locating bolts 35 penetrate the support element 31 as well as the traverse 33 and are guided into guide elements 37 assigned to the traverse 33. In the depiction in FIG. 5, the locating bolts 35 are releasing the floating mounting of the two suction nozzles 30 so that consequently the support element 31 can be tilted together with the suction nozzles 30 in a specific circumference. To fix the support element 31 and thus to block the floating mounting of the suction nozzles 30, the locating bolts 35 are moved downward opposite the position depicted in FIG. 5 so that the phases 38 assigned to the locating bolts 35 engage in corresponding phases of the support element 31. When the printing plates 16 are supposed to be received and transported, the locating bolts 35 block the floating mounting of the support element 31 and thus the suction nozzles 30. If, on the other hand, printing plates are supposed to be transferred to a plate cylinder 13 and be inserted in a lockup slot of the plate cylinder, then the locating bolts 35, on the other hand, release the floating mounting of the support element 31 and thus the suction nozzles 30.

In order to support the insertion of the printing plates in the lockup slot of a plate cylinder, the entire handling element 28 can be assigned a vibration device (not shown) in order to set the same into vibration.

Instead of individual suction nozzles, the handling element 28 embodied as a suction device can also be designed as a continuous suction bar. A negative pressure in the region of the suction nozzles can be made available by compressed air elements 39.

Figure 6:
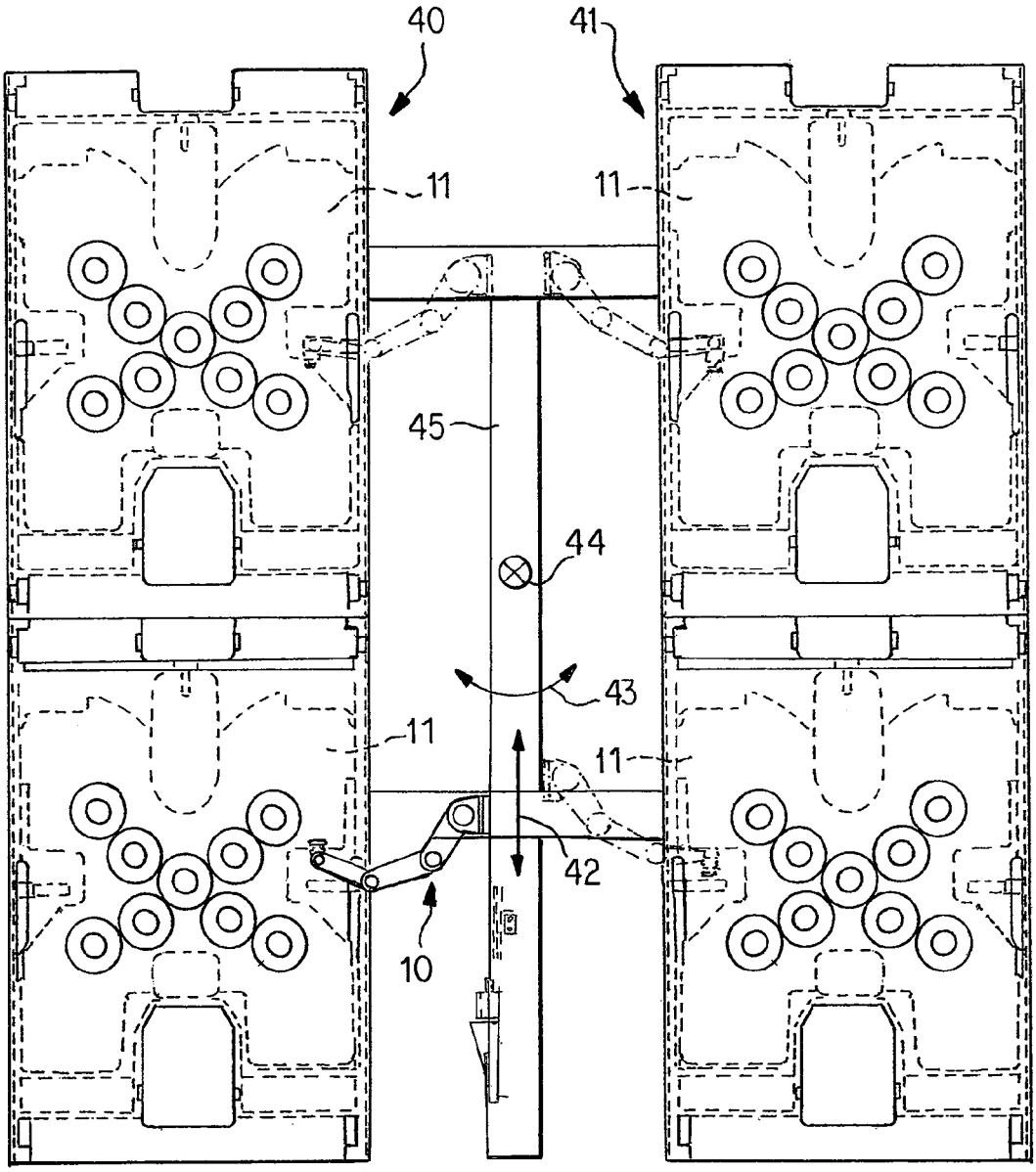
FIG. 6 is a side view of the handling device between two printing towers.

FIG. 6 shows a side view of a handling device 10 between two printing towers 40 and 41. In this case, one end of the handling device 10 is moveably mounted on a traverse 45. The traverse 45 is moveably mounted between the left 40 and right printing tower 41 linearly in direction 44 (in the plane of projection). The traverse 45 together with the handling device 10 can hereby be extended laterally out of the printing towers. In this case, when the handling device 10 is extended, the printing units 11, which are now more readily accessible, can be serviced.

In addition to the swivel axes 23 through 26 that were already described in FIG. 2, the handling device 10 is swivel-mounted or rotationally mounted also in arrow direction 43 so that the printing units 11 of the left 40 and right printing tower 41 can be loaded and unloaded with the handling device 10 (see handling device depicted by dashed lines in the lower right). The handling device 10 can also operate the upper and lower printing units 11 of the same or adjacent printing towers 40 and 41 along the arrow direction 42.

LIST REFERENCE OF NUMBERS

10 Handling device
11 Printing unit
12 Printing couple
13 Plate cylinder
14 Transfer cylinder
15 Impression cylinder
16 Printing plate
17 Web guide wall
18 Manipulator arm
19 Manipulator head
20 Segment
21 Segment
22 Segment
23 Swivel axis
24 Swivel axis
25 Swivel axis
26 Swivel axis
27 Drive
28 Handling element
29 Brace

30 Suction nozzle
31 Support element
32 Ball rollers
33 Traverse
34 Support plate
35 Locating bolt
36 Movement direction
37 Guide element
38 Phase
39 Compressed air element
40 Left printing tower
41 Right printing tower
42 Direction of linear movement
43 Direction of rotational movement
44 Direction of linear movement
45 Traverse for handling device The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A handling device of a printing press for handling a printing plate, comprising:

a manipulator arm, including:

a first segment including a first set of parallel braces;

a second segment including a second set of parallel braces; and a third segment including a third set of parallel braces;

a first swivel axis coupled to adjacent ends of the first set of parallel braces and the second set of parallel braces;

a second swivel axis coupled to adjacent ends of the second set of parallel braces and the third set of parallel braces;

a first drive coupled to the first swivel axis, wherein the first swivel axis is moveable by the first drive;

a second drive coupled to the second swivel axis, wherein the second swivel axis is moveable by the second drive;

wherein the first segment and the second segment are moveable relative to each other by movement of the first swivel axis;

and wherein the second segment and the third segment are moveable relative to each other by movement of the second swivel axis;

a manipulator head coupled to the third segment, wherein the manipulator head includes a handling element engageable with the printing plate; and a support structure, wherein the first segment of the manipulator arm is coupled to the support structure and wherein the manipulator arm is translatorily and rotationally movable via translational and rotational movement of the support structure, respectively.

2. The handling device according to claim 1 in combination with a first printing tower and a second printing tower, wherein the support structure is disposed between the first printing tower and the second printing tower.

* * * * *